US007736603B2

(12) United States Patent
Guyomarc'h

(10) Patent No.: US 7,736,603 B2
(45) Date of Patent: Jun. 15, 2010

(54) THERMAL WASTE RECYCLING METHOD AND SYSTEM

(75) Inventor: Raymond Guyomarc'h, Saint Theodorit (FR)

(73) Assignee: BIO 3D Applications, Paris (FR)

( * ) Notice: Subject to any disclaimer, the term of this patent is extended or adjusted under 35 U.S.C. 154(b) by 767 days.

(21) Appl. No.: 11/579,103

(22) PCT Filed: Apr. 27, 2005

(86) PCT No.: PCT/FR2005/001036

§ 371 (c)(1),
(2), (4) Date: Oct. 27, 2006

(87) PCT Pub. No.: WO2005/106328

PCT Pub. Date: Nov. 10, 2005

(65) Prior Publication Data

US 2007/0234937 A1 Oct. 11, 2007

(30) Foreign Application Priority Data

Apr. 28, 2004 (FR) ..... 04 04482

(51) Int. Cl.

| | |
|---|---|
| ***B01J 19/00*** | (2006.01) |
| *B09B 3/00* | (2006.01) |
| *F23G 5/00* | (2006.01) |
| *F23G 7/00* | (2006.01) |
| *F23K 3/00* | (2006.01) |

(52) U.S. Cl. ..... 422/198; 110/101 R; 110/235; 110/248; 110/267; 110/327

(58) Field of Classification Search ..... 422/198, 422/78; 110/235, 248, 267, 327, 101 R
See application file for complete search history.

(56) References Cited

U.S. PATENT DOCUMENTS

| | | | | |
|---|---|---|---|---|
| 3,508,506 | A * | 4/1970 | Bishop | 110/165 R |
| 3,918,374 | A | 11/1975 | Yamamoto et al. | |
| 5,619,938 | A | 4/1997 | Kaneko | |

FOREIGN PATENT DOCUMENTS

| | | | |
|---|---|---|---|
| JP | 53030480 | A * | 3/1978 |
| WO | WO 02/084178 | A1 | 10/2002 |

OTHER PUBLICATIONS

English translation of WO 2002/084178 A1, which was published on Oct. 24, 2002.*

* cited by examiner

*Primary Examiner*—Walter D Griffin
*Assistant Examiner*—Natasha Young
(74) *Attorney, Agent, or Firm*—Greer, Burns & Crain, Ltd.

(57) ABSTRACT

A system for thermally recycling waste, for example whole used tyres (P) and fractionated waste; includes a first thermal pyrolysis column, having a first thermal base from which combustible gases are produced;

a nozzle for introducing these combustible gases into a second instantaneous combustion and rapid reduction column and igniting them by injection of oxygen, this second reducing column having a second thermal base provided for carrying out purification of the burnt gases and molecular cracking; and a chute for introducing waste into this second column.

18 Claims, 3 Drawing Sheets

THERMAL WASTE RECYCLING METHOD AND SYSTEM

BACKGROUND

The present invention relates to a system for thermally recycling waste, for example whole non-recyclable used tyres (NRUT) and fractionated and similar waste. It also relates to the method implemented in this system.

Very often, the waste which is to be thermally recycled has an overall volume much greater than the real volume of the materials which constitute it.

In particular, the treatment of whole non-recyclable used tyres (NRUT) and of fractionated NRUT and similar waste, such as rubber-based production waste, currently constitutes a significant problem for manufacturers of tyres and the operators of installations for recycling these products, as well as for local authorities.

Growing environmental concerns make it necessary to find effective and economically viable solutions to this problem.

The main difficulty in eliminating whole tyres essentially resides in the disproportion between the volume of the product and the real volume of the material which constitutes it.

The current principle involves shredding the non-recyclable used tyres and/or grinding them in order to get close to the real volume of the material to be eliminated.

SUMMARY

The purpose of the present invention is to propose a thermal waste recycling system, taking into account the need to reduce the volume of this waste.

The principle of the invention involves using high temperatures and very significant thermal capacities in order to very rapidly reduce the volume of the non-recyclable used waste products.

The thermal capacity (quantity of heat) at very high temperatures produces sublimation of the gasifiable parts of the used tyres. The volume of the used tyres is reduced virtually instantaneously.

For this purpose the supply of energy must be of two orders:

1) primary, i.e. originating from a source other than that produced during the combustion of the used tyres;
2) reductive, i.e. allowing the optimum gasification, or even the sublimation of the gasifiable materials from the used tyres, while burning only the minimum amount of materials from these used tyres. In order to obtain this result the energy supplied must have the required capacities:
   - the energy must reach the used tyres from all sides with the same thermal capacities, in order to ensure the rapid reduction of the tyres;
   - the temperature of the method must allow the rapid melting of the metal reinforcement of the used tyres, in order to avoid any risk of clogging and/or vaulting of the reaction zone.

During this method the temperature must not be reduced.

The method must guarantee the complete and instantaneous combustion of the gases and non-gasifiable materials.

It is therefore necessary to provide a primary heat source, knowing that a source produced by fossil fuel or electricity will compromise the benefits of the method.

This objective is achieved with a thermal waste recycling system comprising:

- means for providing, in a first thermal pyrolysis column, primary energy by combustion of a solid fuel, so as to produce a first thermal base and produce combustible gases;
- nozzle means for introducing these combustible gases into a second instantaneous combustion and rapid reduction column and igniting them by the injection of oxygen;
- means for providing, in said second column, primary energy by combustion of a solid fuel, so as to produce a second thermal base constituting means of purification and molecular cracking;
- means for introducing waste into said second column such that said waste is taken between said second thermal base and said ignited combustible gases originating from the nozzle means, and
- means for evacuating the exhaust gases having passed through said second thermal base towards heat exchange means.

In a first embodiment, the first thermal pyrolysis column has an upward flow and the first thermal base is contained by a first grate and is constituted by solid fuels introduced via a first solid fuel supply chute.

The system according to the invention can moreover advantageously comprise a first collection zone connected via a first outlet with first ashpit means, and the flow of combustible gas is maintained forced upwards into the first zone by a negative pressure system.

The second so-called co-combustible material rapid reduction and combustion column preferably has reversed, downward flow, and the second thermal base is contained by a second grate and is constituted by solid fuels introduced via a second solid fuel supply chute.

In this so-called reducing column, the combustion of the thermal pyrolysis gases originating from the first column is carried out. The materials introduced into this column are subjected to the thermal effects originating from the combustion of the gases in the upper part and from the second thermal base contained by the second grate. Taken between these two productions of intense heat, the materials are reduced virtually instantaneously.

The system according to the invention can moreover comprise a second collection and post-combustion zone arranged under the second grate and connected on the one hand to the heat exchange means via a first exhaust outlet and on the other hand with second ashpit means.

The first thermal pyrolysis column moreover comprises substantially inclined tubular grates.

In a second embodiment, the first thermal pyrolysis column moreover comprises a first additional chute for introducing used tyres or other waste in such a manner that they fall onto the first thermal base, this first additional chute being arranged above the first solid fuel supply chute.

In this embodiment, the first two zones of the invention are identical and receive waste, for example whole tyres. The thermolysis/pyrolysis column is then configured in a manner identical to the second zone. The waste is introduced onto the solid-fuel bed where it is subjected to the combined effects of melting/combustion/pyrolysis.

In a third embodiment, the first thermal pyrolysis column moreover comprises a second additional chute for introducing co-combustible waste, said second additional chute being arranged above the first additional chute.

In all these embodiments, the solid fuel supply and/or waste introduction chute(s) is (or are) provided with carbon dioxide $CO_2$ injection means, in order to keep them under excess pressure and airtight, and the nozzle means open through a substantially parabolic base of the combustion chamber.

According to another aspect of the invention, a method is proposed for thermally recycling waste, implemented in the thermal recycling system according to any one of the preceding claims, this method comprising:

- provision, in a first thermal pyrolysis column, of primary energy by combustion of a solid fuel, so as to produce a first thermal base and produce combustible gases;
- introduction of these combustible gases into a second column where their ignition and their combustion are carried out under injection of oxygen;
- provision, in said second column, of primary energy by combustion of a solid fuel, so as to produce a second thermal base achieving purification of the burnt gases and molecular cracking;
- introduction of waste into said second column such that said waste is taken between said second thermal base and said ignited combustible gases originating from the nozzle means, and
- evacuation of the exhaust gases having passed through said second thermal base towards a heat exchange system.

The recycling system according to the invention comprises two distinct and connected zones.

A first zone provides the primary energy source. For this purpose the invention exploits the energy produced by the combustion of waste. This can be organic waste (animal meal, purification-plant sludge, etc.), ordinary and/or special industrial waste, but it can also be used tyres.

The thermal recycling method according to the invention realizes the entire thermal potential of this waste thanks to an integrated thermal base which also contributes to the energy benefits of the system.

This first zone has an upward flow, the general system being maintained under negative pressure by a mechanical method.

The thermal base is contained by a grate and is constituted by solid fuels:

- energy wood in various forms (billets, chips, reconstituted felling chips, pellets, etc.),
- treated, polluted, end-of-life industrial wood (railway sleepers, electricity poles, worn-out pallets, waste wood etc.),
- coals.

The combustible waste (solids, liquids, pastes, powders etc.) are burned on this thermal base, producing 100% of their energy potential and are reduced to combustible gas.

The energy produced and this combustible gas make up a very high-energy gaseous mixture. It is the method's primary energy source and contributes to the overall benefits of the method by eliminating waste and producing energy which can be exploited twice:

1) primary energy which will ensure the rapid reduction in volume of the NRUT introduced into the second zone;
2) recovered energy which, co-generated, contributes to the economic benefits of the method.

This gaseous mixture, containing a significant quantity of combustible gas, enters the second zone via a nozzle where it is ignited by injection of combustive oxygen.

The second zone of the thermal recycling system according to the invention has a reversed, downward flow, forced by the negative pressure system. In its bottom part a second thermal base is contained by a grate. It is constituted by solid fuels. In a preferred form of the invention the solid fuel is densified biomass [Bio-D]® which ensures the break-down and purification of the combustion gases into their elements and their purification. In another form of the invention, this fuel can be the same as that of the first thermal base, the combustion gas then having to be purified by a reducing action filter (RAF).

Under the grate of this second thermal base, there is a post-combustion chamber where the complete combustion of the materials is ensured. An ashpit situated below collects the metal fusions and minerals.

The waste to be eliminated, for example used tyres, is introduced onto this thermal base where it is subjected to the combined thermal effects:

- of the thermal base, to which it contributes, by means of the combustion of the rubber which melts instantaneously, the sublimated gases and pyrolysis carbons (non-gasifiable combustible materials contained in the used tyres), and in which the heat supply is produced by conductivity and radiation);
- of the very high heat supply originating from the nozzle situated in the upper part of this zone. The very hot gases, originating from the first zone, are burnt there under combustive oxygen and realize the whole of their thermal potential, this heat supply being produced by conductivity and intense radiation.

The combined action of these thermal effects will result in melting/gasification/sublimation of most of the rubber which makes up the used tyres.

These materials burn using the surplus combustive oxygen allowed (under permanent control) into the nozzle. This other source of energy is situated within the used tyres introduced into the system, and it is the internal means of the method which provides the used tyres with the reduction heat capacity.

The combination of these thermal effects produces the virtually instantaneous reduction in volume of the used tyres, which collapse in on themselves. The energy necessary for the changes in state of the material is provided under permanent control, in order to ensure maintenance of the temperature necessary for melting the metal contained in the used tyres.

The thermal base receives the rubber fusions and the non-gasifiable combustible solids. The combustible gases penetrate it, whilst the burnt gases and the metal fusions pass through it. An injection of combustive oxygen, situated within this solid thermal base, reduces this new combustible mixture and the burnt gases to their native elements.

The temperature generated within this reactor (equal to or greater than 1600° C.) cracks the molecules.

The gaseous mixture which results is loaded with charcoal particles, unburnt and at a very high temperature (stripped from the solid fuel which constitutes the thermal base). The injection of combustive oxygen situated under the grate ignites these particles, and the combustion is completed in the post-combustion chamber.

The thermal recycling method according to the invention provides the surest means of guaranteeing the complete combustion of the thermal pyrolysis gas and of the non-gasifiable combustible solids. The method guarantees 100% realization of the combined thermal potential of the used tyres and thermal bases.

The combustion gases are then sucked into the heat recovery system. At this point the residual oxygen in the combustion gas is monitored continuously in order to ensure that there is no trace.

All the energy contained in the combustion gas is recovered and co-generated into electricity and exploitable heat.

The solid fuel can for example comprise end-of-life wood waste, or treated wood polluted with chemical elements or compounds, or any other solid fuel such as coal or reconstituted wood.

The thermal base is thus homogeneous and guarantees the impossibility of being passed through by any form of combustible material without it being completely burned. It guarantees the homogeneity of the thermal flow responsible for gasifying the materials in the thermolysis/pyrolysis column. Its temperature, 1600° C., guarantees the fluidity of the fusions which pass through it without changing state.

The combustive injected into the furnace is preferably oxygen, but it can also be atmospheric air.

The thermal recycling system according to the invention can moreover advantageously comprise means for hydraulically cooling down the walls of the furnace, its grate and the walls of the ashpit, and airtight means for supplying the furnace with solid fuel.

The thermolysis/pyrolysis column can comprise tubes inclined towards the furnace and thermally controlled.

The inclination of the tubes is determined as a function of a desired flow speed and the density of the materials to be incinerated.

The homogenization chamber is finished by a nozzle proportional to the required flow-rates, the end of which opens into the thermal pyrolysis gas combustion chamber situated in the second zone of the invention. Means are provided for varying the flow-rate of gas in the nozzle.

The second zone comprises in its bottom part, a solid fuel furnace with reversed (downward) flow comprising a grate receiving the solid fuel, which constitutes the reactive thermal base on which the gases and combustible materials are completely reduced.

The average temperature of this furnace is greater than or equal to 1600° C. An airtight chute under excess pressure of $CO_2$ supplies this furnace with densified biomass [Bio-D]. This chute is situated in the upper part of the furnace, at the limit of the median part. The supply is continuous. This furnace is supplied with combustive by $O_2$ injectors arranged in the top part of the mass of solid fuel [Bio-D]. These injectors are oriented towards the grate, in the direction of the flow, in order to produce the thermal reaction of combustion and cracking/reduction of the gas.

The top part of the second zone comprises a combustion chamber for the thermal pyrolysis gases originating from the first zone of the invention.

The median part of the second zone comprises a rapid reduction column, where the whole tyres are subjected to the thermal release of the thermal pyrolysis gases from the first zone, which are ignited on passing through the nozzle situated above. This thermal energy gasifies and instantaneously ignites the volatile substances contained in the whole tyres, this combined combustion takes the NRUT to a very high temperature promoting the instantaneous combustion of the combustible materials and the melting of the metal parts contained in these products.

An airtight chute under excess pressure of $CO_2$ allows the introduction of whole tyres. This chute is configured in order to allow the tyres to pass by gravity without being able to get jammed, it can be adapted to the introduction of all sizes of tyres.

Under the grate of the solid-fuel furnace, a post-combustion chamber receives the combustive injectors. The gases and the solid-fuel particles are reduced there to their native elements by the very high temperature reached, greater than 1800° C.

This post-combustion chamber opens into the exhaust duct towards the heat recovery zone.

The solid fuel used in this zone is necessarily densified biomass [Bio-D], if the invention is not integrated into a Reducing Action Filter (RAF) type purification system.

In an installation integrated into this purification system, the solid fuel can for example comprise end-of-life wood waste, or treated wood polluted with chemical elements or compounds, or any other solid fuel such as coal or reconstituted wood.

The combustive injected into this furnace is oxygen $O_2$.

The solid fuel furnace in practice comprises an ashpit arranged under the grate, for receiving ashes and non-gasifiable heavy metals.

The system according to the invention can moreover advantageously comprise means for hydraulically cooling down the walls of the furnace, its grate and the walls of the ashpit, and airtight means for supplying the furnace with solid fuel.

The heat exchange system arranged downstream of the thermal recycling system according to the invention is arranged in order to carry out condensation/solidification of the elements (reduced to the native state by molecular cracking) contained in the exhaust gases originating from the thermal purification means, and low-temperature condensation of the water at a pressure below atmospheric pressure.

The heat exchange system can moreover comprise negative pressure means arranged in order to maintain the water contained in the exhaust gases in the dry vapour state up to its condensation pressure-temperature zone.

A secondary exchanger, downstream of the heat exchange means, operating as an evaporator for the liquid oxygen, cools down the exhaust gases and allows the condensation of the steam, means for recovering the condensed water by gravity avoiding any entry of additional air.

The carbon dioxide condensation device comprises the refrigeration systems defined by the oxygen supplier.

The melting of the rubber is rapid on the solid-fuel bed at 1600° C., the change of state is virtually sublime. The sublimated part burns instantaneously and the heat produced contributes to the pyrolysis of the residual tyre.

The high heat release produced achieves the thermal pyrolysis of the whole tyres which are continuously introduced into the column. The steel content melts as the combustion/pyrolysis proceeds and passes through the mass of solid fuel in ignition. The liquid steel is collected in the ashpit, equipped with known means for separating the minerals, in order to be recycled. The introduction of combustive, preferably oxygen or superoxygenated air, is apportioned in order to promote the conditions for thermal pyrolysis of the whole tyres.

In this way, the thermal pyrolysis gases retain a combustion capacity sufficient to fulfill their role in the second zone of the invention.

In this other particular embodiment the solid fuel can for example comprise end-of-life wood waste, or treated wood polluted with chemical elements or compounds, or any other solid fuel such as coal or reconstituted wood.

Cooling means can for example be installed in the interior space of a double wall provided for cooling zones of the system in contact with the heat sources of said system.

BRIEF DESCRIPTION OF THE DRAWINGS

Other advantages and characteristics of the invention will become apparent on examination of the detailed description of several embodiments which are in no way limitative, and the attached drawings in which.

DETAILED DESCRIPTION OF THE PREFFERED EMBODIMENTS

A description follows, with reference to the abovementioned figures, of three embodiment examples of a recycling system according to the invention, at the same time as the method implemented in this system.

The elements and components common to the three embodiments illustrated by each of the three figures are labeled with the same reference numbers.

Figure 1:
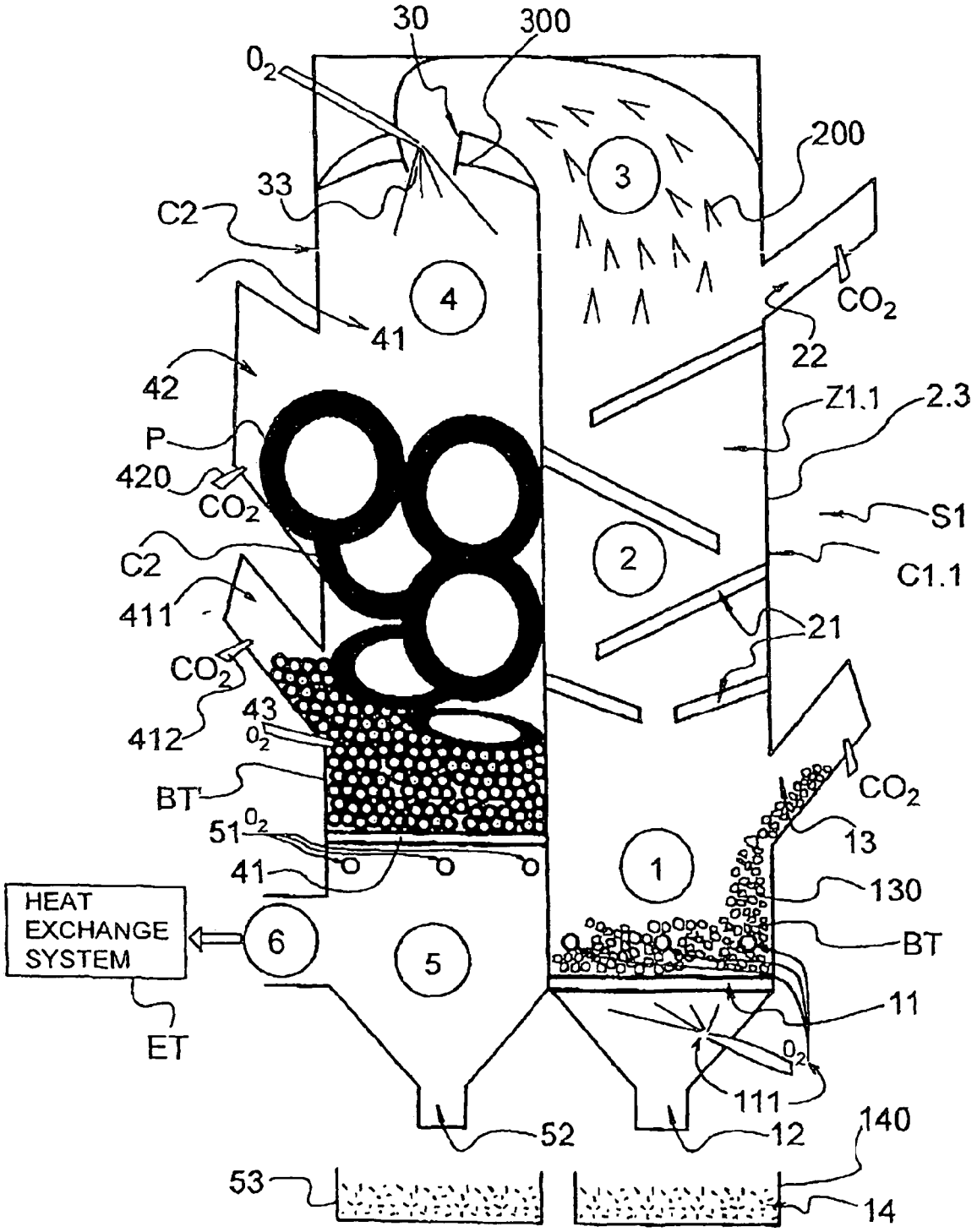
FIG. 1 diagrammatically illustrates a first embodiment of a thermal recycling system according to the invention, in which whole used tyres are introduced into the instantaneous reduction column with downward flow.

In a first embodiment example illustrated by FIG. 1, the thermal recycling system S1 comprises several distinct, concomitant and connected parts:

- a thermal pyrolysis column C1.1 with upward flow,
- a column C2 for the reduction and instantaneous combustion of the whole tyres,
- a thermal purification and molecular cracking reactor 4, and
- a heat exchange system ET comprising a condenser and an element concentrator (not shown).

The method according to the invention takes place continuously, with interactive and simultaneous operation. The thermal recycling system S1 is maintained under controlled negative pressure in order to avoid any concentration of gas.

The thermal pyrolysis column C1.1 comprises three zones:

- a solid-fuel furnace 1,
- a thermolysis/pyrolysis column 2,
- a chamber 3 for homogenization of the burnt gases and volatile fuels.

The solid-fuel furnace 1, with upward flow, comprises a grate 11 receiving the fuel and injectors 111 for combustive.

The solid fuel 130 can be end-of-life wood waste, treated wood polluted with chemical elements CCA (Copper, Chromium, Arsenic), PAH creosotes, or PCPs (woods treated with "organochlorines") and/or densified biomass [Bio-D]®.

The solid fuel of densified biomass type [Bio-D]® marketed by the applicant, which is by its nature free from any pollutant, is only used in the final method of the system: purification/break-down of the combustion gases to their elements. The size of the solid fuel must correspond to the use to which it is put.

In the method according to the invention, oxygen can be used as the exclusive combustive for the combustion of the solid fuel, in particular of the fuel [Bio-D]®.

The role of the solid fuel at this point is to constitute a regulating thermal base BT, totally impassable by combustible solid bodies (carbons from waste following thermal-pyrolysis) as well as by the combustible fusions. Its thickness is adjusted to the expected functions.

Its temperature develops to between 1500 and 1600° C., which allows complete combustion of the carbons from waste and other combustible materials and the flow of the materials from the melting which takes place in the column.

In this zone, the combustive is preferably oxygen $O_2$, it can however be "atmospheric" air enriched or not enriched with $O_2$. The gases originating from this zone are purified and cracked on passing through the reactor.

The injection of the combustive is forced. It takes place primarily under the grate 11 and secondarily within the thermal base. Thus a very reactive incandescent bed, which is easily controllable, is obtained.

This standard design furnace is made from special steel in order to make it possible to obtain very high temperatures, typically 1600° C.

Under the grate 11, an ashpit 14, made airtight by a slight overpressure of $CO_2$, receives the non-combustible residues via an outlet opening 12:

- the ashes composed essentially of minerals contained in the fuel and the incinerated waste.
- the non-gasifiable heavy metals etc.

The walls 23 of the system, its furnace grate 11, the tubular grates 21 and the walls 140 of the ashpit 14 are cooled down by a hydraulic cooling system down (not shown), so as to maintain their nominal use temperature, typically 1200° C.

An airtight chute 13 is arranged above the grate 11, in order to supply it with solid fuel. This supply is continuous and controlled in order to avoid any entry of additional air.

The thermolysis/pyrolysis column 2 constitutes a zone with volume at a height suited to the gasification heat acquisition of the volatile substances contained by the waste.

Tubular grates 21 inclined towards the furnace, and thermally controlled, are arranged in this volume for progressive heat acquisition.

The inclination is relative to the desired flow rate, according to the density of the materials to be incinerated. The atmosphere of this zone is reductive. It is controlled continuously so as to eliminate any possibility of residual oxygen. The thermal base BT is continuously managed and controlled in order to:

- provide the thermal capacity required for volatilization of the gasifiable organic materials contained in the waste,
- ensure the complete combustion of carbons from the thermal pyrolysis and the combustible materials which come into contact with it,
- guarantee the total absorption of the combustive oxygen.

A chute 22 for the supply of waste is situated above the tubular grates 21. It is airtight and controlled by a forced flow of $CO_2$, in order to avoid any entry of additional air. It is via this chute that waste is introduced, for example dry materials originating from sludge and slurry.

A percentage of solid fuel, injected into the waste supply chute 22, can facilitate their flow and the constant declogging of the grates of the column.

In the method according to the invention, waste with a high energy potential, shredded tyres, animal meal, etc. are introduced via this chute 22 into the thermolysis/pyrolysis column 2. The elimination of this waste provides the energy necessary for the thermal recycling of the used tyres.

The chamber 3 for homogenization of the burnt gases 200 and volatile fuels is finished by a nozzle 30 proportional to the flow rates required. A hydraulic system (not shown) makes it possible to vary the flow-rate of the gas in this nozzle. It acts on the pressure drops and on the control of thermal capacities, in play in the column. The end of the nozzle opens into the thermal pyrolysis gas combustion chamber 4. At this level the gases contain no trace of oxygen $O_2$, and are at a minimum temperature of 1400° C.

The thermal pyrolysis gas combustion chamber 4 comprises a parabolic base 300 into which the gas nozzle 30 opens.

The nozzle 30 is provided with $O_2$ injectors 33 which allow the instantaneous ignition of the gases as soon as they enter the chamber.

The walls of the combustion chamber 4 are regulated by a hydraulic cooling system.

The gases burn in the rapid reduction and downward-flow instantaneous combustion column C2. This column comprises:

- a first chute 42 with dimensions suitable for allowing the introduction of whole used tyres,
- a second chute 411 provided for the introduction of solid fuel, for example densified biomass [Bio-D]®,
- a second furnace grate 41 on which the solid fuel in combustion produces a second thermal base BT'.

The chutes 42, 411 are provided with carbon dioxide $CO_2$ injectors 420, 412 in order to maintain them under excess pressure and ensure their air-tightness.

The furnace constituted by the second grate 41 is provided with means 43, 51 for injecting combustive $O_2$ arranged both at the level of the thermal base BT' and under the grate 41.

The post-combustion zone 5, situated under the second grate 41 receives on the one hand the purified gases pass through the thermal base BT'and become loaded with carbon during the passage. The post-combustion reduces all the residual fuels, and the gases, broken down into their elements, are conveyed by negative pressure towards the heat exchange system ST via the outlet 6, and on the other hand, the ashes and non-combustible particles which are evacuated via the outlet 52 and collected in the ashpit 52.

The system thus used for thermal purification and molecular cracking is called a "Reducing Action Filter" (RAF) . It is a system for the treatment of hot or cold, charged and polluted industrial fumes and gases.

The RAF system is designed to carry out the complete filtration of the gaseous effluents and the thermal cracking of the compound molecules. The RAF system, designed as a solid fuel heat generator, is configured for the use of solid fuel [Bio-D]® which, burnt at a very high temperature under pure oxygen, constitutes beds of fluid and permanent embers.

These highly reactive ember beds are passed through by gaseous effluents: fumes, degassings, air from various treatments, exhaust gases from industrial systems, etc.

A reactor is therefore provided which thermally reduces polluted gas to its native elements, regardless of their temperature or the type of pollution.

The operating principle makes use of all the available oxygen molecules, introduced or existing in the effluent. These molecules combine with the carbon elements to form $CO_2$, accelerating the transfer of heat within the reactor.

The leaving gases comprise only $CO_2$ and non-combined native elements, at this level of the method, there is no more $O_2$ available. The hydrogen contained in the gases contributes to the heat generation and combines to produce $H_2O$.

The exhaust gas is composed of $CO_2$, $H_2O$ in the high-temperature dry vapour state and native elements contained in the treated waste. This gas is sucked towards the heat exchange system ST where it yields all the thermal energy contained. It should be noted that the RAF system is useful in this first embodiment only if the co-combustible waste is other than tyres, or if a thermal base (or bases) BT is (are) composed of solid fuels other than [Bio-D]® and therefore if the combustion gas needs to be purified.

Figure 2:
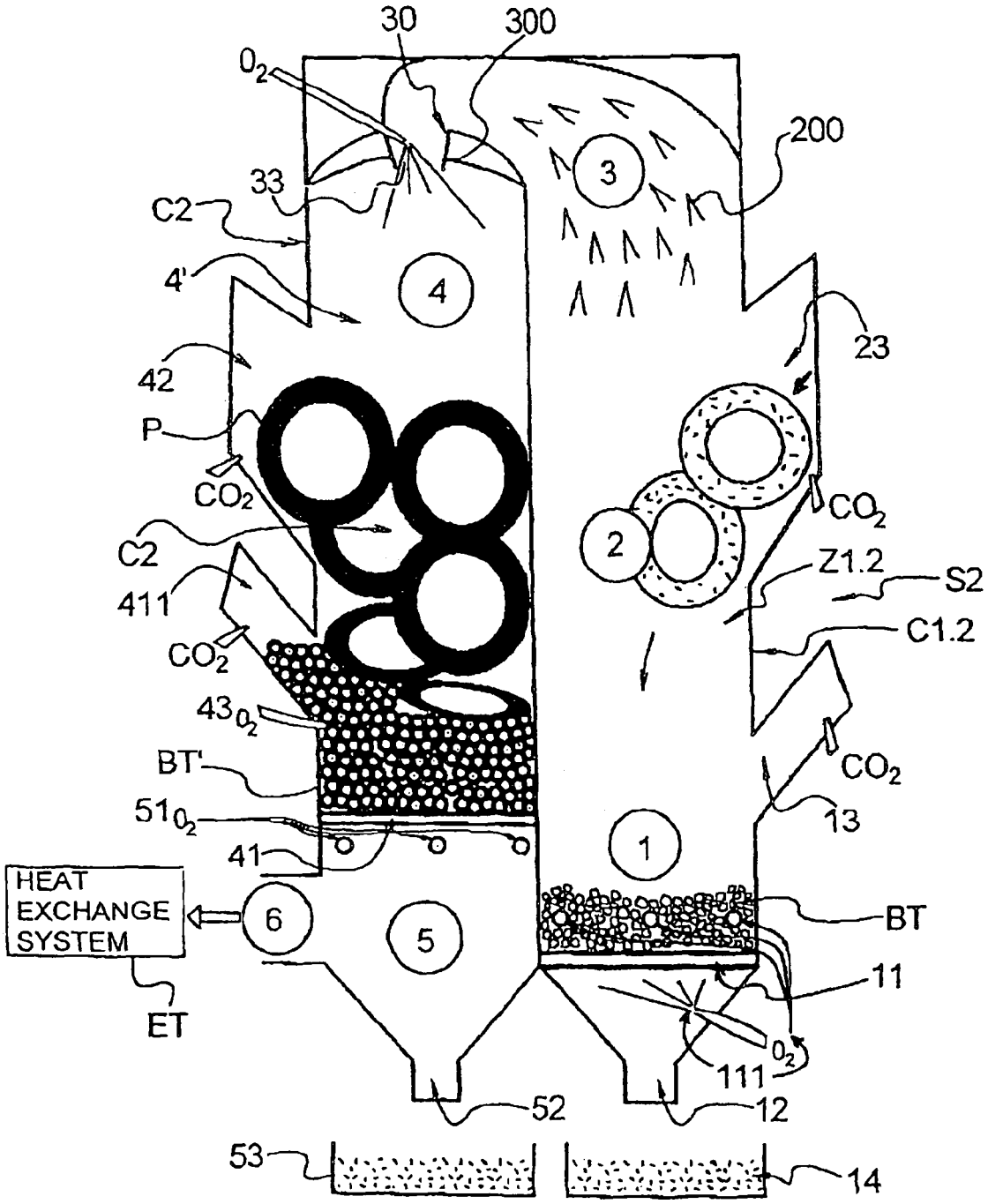
FIG. 2 diagrammatically illustrates a second embodiment of a thermal recycling system according to the invention, in which used tyres are introduced into the reduction column with downward flow, this system comprising moreover an opening for the introduction of whole tyres into the thermal pyrolysis column with upward flow.

In a second embodiment illustrated by FIG. 2, the thermal recycling system S2 according to the invention, has, with respect to the system S1 which has just been described, an additional chute 23 provided for introducing whole used tyres into the thermolysis pyrolysis column 2. This additional chute 23 is equipped with a carbon dioxide $CO_2$ injection device which ensures the air-tightness of this chute by maintaining it under excess pressure. The used tyres introduced via this chute 23 are thrown directly onto the thermal base BT in order be burnt and pyrolyzed there.

Figure 3:
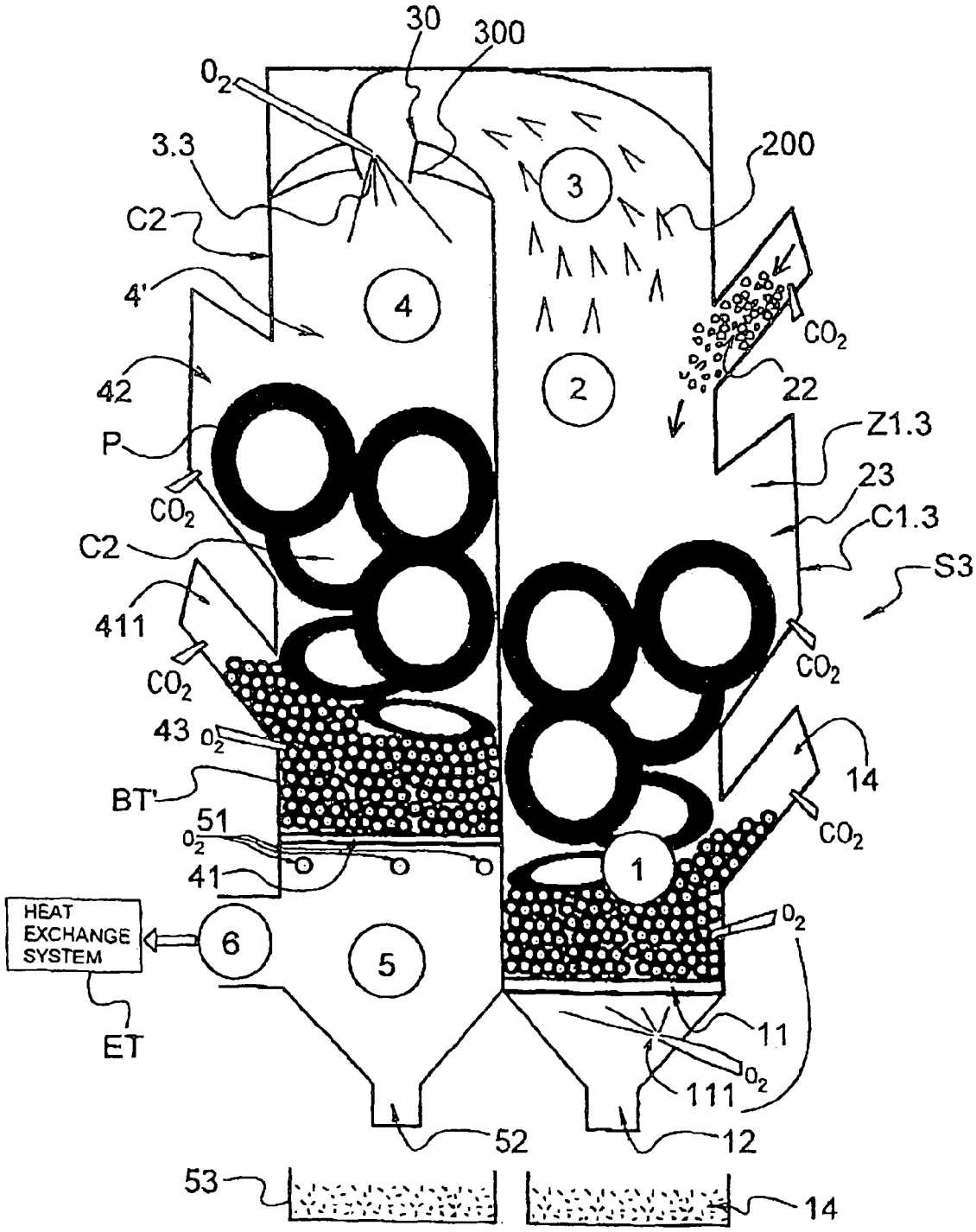
FIG. 3 diagrammatically illustrates a third embodiment of a thermal recycling system according to the invention, in which used tyres can be introduced both into the reduction column with downward flow and into the thermal pyrolysis column with upward flow at the same time as fragmented combustible waste (which can be shredded used tyres and production waste, meal of animal origin, dry sludge, etc.).

In a third embodiment illustrated by FIG. 3, the thermal recycling system S3 according to the invention has, with respect to the system S2 which has just been described, a second additional chute 22, arranged above the chute 23 for introduction of the whole, used tyres, and envisaged for introducing waste fuels, for example shredded tyres, animal meal, dry purification plant sludge and slurry, or industrial waste. This second additional chute 22 is also provided with a carbon dioxide injection device.

Of course, the invention is not limited to the examples which have just been described and numerous adjustments can be made to these examples without exceeding the scope of the invention.

Thus, the thermal recycling system and method according to the invention can be implemented for the elimination of all types of waste, in addition to just used tyres and fractionated and similar waste.

The invention claimed is:

1. A thermal waste recycling system comprising:

means for providing, in a first thermal pyrolysis column, primary energy by combustion of a solid fuel, so as to produce a first thermal base and to produce combustible gases;

nozzle means for introducing these combustible gases into a second rapid reduction and instantaneous combustion (so-called reducing) column and igniting them by injection of oxygen;

means for providing, in said second column, primary energy by the combustion of a solid fuel, so as to produce a second thermal base constituting means for purification and molecular cracking;

means for introducing waste into said second reducing column such that said waste is taken between said second thermal base and said ignited combustible gases originating from the nozzle means, and means for evacuating the exhaust gases having passed through said second thermal base towards heat exchange means.

2. The system according to claim 1, characterized in that the first thermal pyrolysis column has an upward flow.

3. The system according to claim 1, wherein the first thermal base is contained by a first grate and is constituted by solid fuels introduced via a first solid fuel supply chute.

4. The system according to claim 3, characterized in that it comprises moreover a first collection zone connected via a first outlet with first ashpit means.

5. The system according to claim 2, wherein the flow of combustible gas is maintained forced upwards in the first thermal pyrolysis column by a negative pressure system.

6. The system according to claim 1, wherein the second reducing column has a reversed and downward flow.

7. The system according to claim 3, wherein the second thermal base is contained by a second grate and is constituted by solid fuels in the process of melting introduced via a second solid fuel supply chute.

8. The system according to claim 7, characterized in that it comprises moreover a second collection zone arranged under the second grate and connected on the one hand to the heat exchange means via a first exhaust outlet and on the other hand with second ashpit means.

9. The system according to claim 1, wherein the first thermal pyrolysis column comprises moreover tubular grates substantially inclined towards the first thermal base.

10. The system according to claim 1, wherein the first thermal pyrolysis column moreover comprises a first additional chute for introducing waste in such a manner that it falls onto the first thermal base, said first additional chute being arranged above the first solid fuel supply chute.

11. The system according to claim 10, characterized in that the first thermal pyrolysis column comprises moreover a second additional chute for introducing solid fuel, said second additional chute being arranged above the first additional chute.

12. The system according to claim 1, characterized in that the solid fuel supply and/or waste introduction chutes is provided with carbon dioxide $CO_2$ injection means.

13. They system according to claim 1, wherein the nozzle means open through a substantially parabolic base of the combustion chamber.

14. A thermal waste recycling method, implemented in the thermal recycling system according to claim 1, this method comprising:

provision, in a first thermal pyrolysis column, of primary energy by combustion of a solid fuel, so as to produce a first thermal base and produce combustible gases;

introduction of these combustible gases into a second instantaneous combustion and rapid reduction (reducing) column and their ignition by injection of oxygen;

provision, in said second column, of primary energy by combustion of a solid fuel, so as to produce a second thermal base achieving purification of the burnt gases and molecular cracking;

introduction of waste into said second column such that said waste is taken between said second thermal base and said ignited combustible gases originating from the nozzle means; and evacuation of the exhaust gases having passed through said second thermal base towards a heat exchange system.

15. The method according to claim 14, characterized in that the flow of combustible gases and combustion particles is upward in the first thermal pyrolysis column.

16. The method according to claim 15, characterized in that the flow of burnt gases and combustible gases are downward in the second reducing column.

17. The system according to claim 1, wherein said waste includes used tires.

18. The system according to claim 1, wherein at least one of said means for providing primary energy of a solid fuel in said first column, said means for providing primary energy by the combustion of solid fuel in said second column and said means for introducing waste into said second column includes a carbon dioxide injector for maintaining positive pressure and ensuring air-tightness.

* * * * *